US009828840B2

(12) United States Patent
Dawson

(10) Patent No.: US 9,828,840 B2
(45) Date of Patent: Nov. 28, 2017

(54) PRODUCING HYDROCARBONS

(71) Applicant: Statoil Gulf Services LLC, Houston, TX (US)

(72) Inventor: Matthew Dawson, Houston, TX (US)

(73) Assignee: STATOIL GULF SERVICES LLC, Houston, TX (US)

( * ) Notice: Subject to any disclaimer, the term of this patent is extended or adjusted under 35 U.S.C. 154(b) by 694 days.

(21) Appl. No.: 14/033,079

(22) Filed: Sep. 20, 2013

(65) Prior Publication Data

US 2015/0083398 A1 Mar. 26, 2015

(51) Int. Cl.

| | |
|---|---|
| ***E21B 43/17*** | (2006.01) |
| ***E21B 43/16*** | (2006.01) |
| ***E21B 43/25*** | (2006.01) |
| ***E21B 43/26*** | (2006.01) |

(52) U.S. Cl.

CPC ..... *E21B 43/16* (2013.01); *E21B 43/162* (2013.01); *E21B 43/17* (2013.01); *E21B 43/255* (2013.01); *E21B 43/26* (2013.01)

(58) Field of Classification Search

CPC ..... E21B 43/162; E21B 43/17

See application file for complete search history.

(56) References Cited

U.S. PATENT DOCUMENTS 3,358,756 A * 12/1967 Vogel ..... E21B 43/2405 166/266
3,513,914 A * 5/1970 Vogel ..... E21B 43/24 166/259
3,739,851 A * 6/1973 Beard ..... E21B 43/281 166/254.1
3,888,307 A * 6/1975 Closmann ..... E21B 43/281 166/401
3,908,762 A * 9/1975 Redford ..... E21B 43/168 166/269
4,889,186 A 12/1989 Hanson et al.
5,025,859 A 6/1991 Hanson et al.
(Continued)

FOREIGN PATENT DOCUMENTS

CA 2 820 742 A1 9/2013
GB 2 379 685 A 3/2003

OTHER PUBLICATIONS

Form PCT/ISA/237; pp. 1-6.

*Primary Examiner* — Robert E Fuller
(74) *Attorney, Agent, or Firm* — Birch, Stewart, Kolasch & Birch, LLP

(57) ABSTRACT

A method and apparatus for producing hydrocarbons from a subterranean formation. A first well is provided in the formation, the first well being separated by an isolating material into at least a first and second zone, the first zone being substantially isolated from the second zone. A second well is provided in the formation. The second well is separated by an isolating material into at least a first and second zone, the first zone being substantially isolated from the second zone. A first fracture is provided in the formation, the first fracture extending substantially between the first zones. A second fracture is provided in the formation, the second fracture extending substantially between the second zones of the first and second wells. A fluid is injected into the formation from the first zone in the first well. Hydrocarbons are produced at the second zone of the second well.

20 Claims, 3 Drawing Sheets

(56) References Cited

U.S. PATENT DOCUMENTS

| | | | | |
|---|---|---|---|---|
| 5,095,983 | A * | 3/1992 | Magnani | E21B 33/127 166/113 |
| 7,152,677 | B2 * | 12/2006 | Parlar | E21B 43/04 166/177.5 |
| 7,441,603 | B2 * | 10/2008 | Kaminsky | E21B 43/2405 166/266 |
| 8,122,953 | B2 * | 2/2012 | Cavender | E21B 43/305 166/250.01 |
| 8,893,787 | B2 * | 11/2014 | Tips | 166/263 |
| 2013/0228337 | A1 | 9/2013 | Dombrowski et al. | |

* cited by examiner

PRODUCING HYDROCARBONS

TECHNICAL FIELD

The present invention relates to the field of producing hydrocarbons.

BACKGROUND

In order to improve the efficiency of extracting hydrocarbons from subterranean formations, it is known to inducing and/or extend existing fractures and cracks in the subterranean formation. Fractures may extend many meters and tens or even hundreds of meters from a main wellbore from which they originate.

As hydrocarbon-bearing formations are often disposed substantially horizontally, in many cases it is preferred to use horizontal drilling and fracking operations (inducing fractures in the formation) may be carried out on a single well. This may be accomplished by, for example, retracting open slots in an liner along the borehole. A common method to induce fractures is by hydraulic fracturing. In this case, a fluid is pumped into the formation via the wellbore at high pressures. The pressure can be up to around 600 bar. The first fractures may be created by the use of explosive materials, and these are extended by the high pressure fluid. The most commonly used fracking fluid is water with added chemicals and solid particles. Typically the solids, termed proppants, make up 5-15 volume % of the fracking fluid, chemicals make up 1-2 volume % and the remainder is water.

Other fracking fluids include freshwater, saltwater, nitrogen, $CO_2$ and various types of hydrocarbons, e.g. alkanes such as propane or liquid petroleum gas (LPG), natural gas and diesel. The fracking fluid may also include substances such as hydrogen peroxide, propellants (typically monopropellants), ac ids, bases, surfactants, alcohols and the like.

Once area of interest is improving recovery beyond primary depletion for tight oil reservoirs, and in particular what are often referred to as shale oil reservoirs. Shale oil reservoirs primarily comprise liquid hydrocarbons in a low permeability formation. Owing to the low permeability, oil production from shale oil reservoirs is improved by fracturing the formation to provide paths of enhanced permeability along which hydrocarbons can flow. Operators have begun to develop what were previously uneconomic assets using a combination of hydraulic fracturing and long horizontal wells. However, while these can give promising initial yields, production rates from primary depletion often dramatically decline, yielding only a small fraction of the initial production rate after several years. Moreover, primary depletion only recovers a fraction of the Original Oil in Place (OOIP); typical recovery factors for some assets are often assumed to be on the order of 5-15%. These shortcomings are due to the low permeability of the reservoirs and the lack of a sufficient drive mechanism which, in the case of primary depletion, is often reservoir compaction and oil volume expansion.

Some operators have considered water-flooding to enhance production, but the oil-wet to mixed-wet nature of the target reservoirs, the low relative permeability to water, and injectivity/plugging issues have often made traditional water-flooding techniques unattractive in shale oil reservoirs.

Gas flooding has shown more promise as an Enhanced Oil Recovery (EOR) method for shale oil reservoirs. Gas floods in these reservoirs are often miscible and can provide additional forms of drive mechanisms including pressure support, oil swelling, and gravity drainage. Several gas flooding pilots have been carried out, but no known commercial developments have commenced in the largest shale oil reservoirs because the pilots have experienced challenges. The foremost challenge these pilots have experienced is rapid channeling from injectors to producers. The cause of this rapid channeling is uncertain but often attributed to some form of natural or induced fracture network. It is well known that during hydraulic stimulation of some of these wells, fluid communication can occur with adjacent wells. The entirety of every hydraulically stimulated fracture may not be propped, but after a fracture in a rock is created, lab experiments show they have potential to have significantly higher permeability than the surrounding matrix or unstimulated rock volume typically found in shale oil reservoirs, particularly under lower effective stresses, as would be experienced under gas injection. These stimulated zones may contribute toward the rapid communication between injection wells and production wells that has been observed in previous field tests, resulting in gas channeling, and uneconomic gas floods.

Another key challenge is the low matrix permeability, which necessitates short flooding distances or higher pressure gradients to achieve economically attractive flood durations. Some technologies have been proposed to reduce the distance that fluid must travel, such as flooding between transverse fractures from two wells placed in close proximity to one another. However, this solution is potentially expensive (as it requires one well which does not contribute effectively to primary production), and it does not address the issue of rapid channeling due to fractures. To reduce costs, it has been proposed that flooding between adjacent fractures is carried out in a single well; however, the completions challenges associated with this concept are significant, particularly for ultra-tight reservoirs with horizontal wells, which often utilize dozens of fracture stages and small diameter liners in the pay.

Additional solutions have been proposed of plugging fractures with various injectants such as polymers or gels. However, very little is known about how those plugging agents would impact ultra-tight formations (e.g., what the affect would be on matrix pore plugging, how these plugging agents would transport through the fracture system, and how effectively they could block off the entire fracture system).

SUMMARY

It is an object to provide an improved mechanism for extracting hydrocarbons, particularly from low permeability formations such as shale oil reservoirs.

According to a first aspect, there is provided a method of producing hydrocarbons from a subterranean formation. A first well is provided in the formation. The first well is separated by an isolating material into at least a first and a second zone, the first zone being substantially isolated from the second zone. A second well is also provided in the formation. The second well is separated by an isolating material into at least a first and a second zone, the first zone being substantially isolated from the second zone. A first fracture is provided in the formation, the first fracture extending substantially between the first zones of the first and second wells. A second fracture is also provided in the formation, the second fracture extending substantially between the second zones of the first and second wells. A fluid is injected into the formation from the first zone in the first well, and hydrocarbons are produced at the second zone of the second well. An advantage of this is that more of the formation between a series of fractures is put under pressure and more of hydrocarbons in the formation become accessible for production.

As an option, each zone is provided with openable openings providing a communicating path between the wells and the formation. The openings in the first zone of the first well and the second zone of the second well are opened, and the openings in the second zone of the first well and the first zone of the second well are closed. This ensures that the injection fluid traverses the formation between the two wells.

Optional examples of injection fluid are carbon dioxide, hydrocarbons, methane, produced gas, nitrogen, hydrogen sulphide, water, surfactant, alkali, ketones, alcohols, aromatic hydrocarbons, hydrocarbons, solvents, and acid.

The fluid is optionally any of a diluent, a solvent, a reactant and a surfactant.

Any suitable means may be used to induce the fractures, such as hydraulic fracturing, thermal fracturing, mechanical fracturing, and a combination thereof.

As an option, at least a portion of the first and second fractures are substantially perpendicular to a main axis of the first and second wells.

The first and second wells are optionally disposed substantially horizontally in the subterranean formation, although it will be appreciated that this is not a necessary condition.

The method finds particular use in a subterranean formation that comprises a low permeability formation. An example of a low permeability formation is one with a substantial volume fraction of the formation having an absolute permeability less than 100 mD.

There are various ways to hydraulically isolate the first and second zones of each well. Examples include using any of a packer, a swell packer, a hydraulically set packer, and cement.

As certain regions of the formation become depleted of hydrocarbons, the location of the interface between the zones can be changed to optimise hydrocarbon production.

According to a second aspect, there is provided a system for producing hydrocarbons from a subterranean formation. The system includes a first well in the formation, the first well separated by an isolating material into at least a first and a second zone, the first zone being substantially isolated from the second zone. A second well in the formation is provided, the second well separated by an isolating material into at least a first and a second zone, the first zone being substantially isolated from the second zone. The system includes a first fracture in the formation, the first fracture extending substantially between the first zones of the first and second wells. A second fracture is also present in the formation, the second fracture extending substantially between the second zones of the first and second wells. An injector is provided for injecting a fluid into the formation from the first zone in the first well, wherein the injection of the fluid leads to production of the hydrocarbons at the second zone of the second well.

The system optionally includes openable openings in each zone, the openings providing a communicating path between each well and the formation.

The injected fluid is optionally selected from any of carbon dioxide, hydrocarbons, methane, produced gas, nitrogen, hydrogen sulphide, water, surfactant, alkali, ketones, alcohols, aromatic hydrocarbons, hydrocarbons, solvents, and acid.

As an option, the injected fluid is any of a diluent, a solvent, a reactant and a surfactant.

The first and second fractures are optionally substantially perpendicular to a main axis of the first and second wells.

As an option, the first and second wells are disposed substantially horizontally in the subterranean formation.

The system is particularly useful in subterranean formations that have a low permeability formation, such as shale or shale-rich formations.

There are various ways in which the first and second zone of the each wellbore can be hydraulically isolated from each other, for example using any of a packer, a swell packer, a hydraulically set packer and cement.

DETAILED DESCRIPTION

Described herein is a method and system for enhanced oil recovery, which can be particularly useful for tight and ultra-tight formations such as but not restricted to shale oil formations or formations considered to be shale-rich formations. Reservoirs in low or ultra-low permeability formations are often termed shale reservoirs, but may also be other types of reservoir such as tight carbonate or sandstone.

Figure 1:
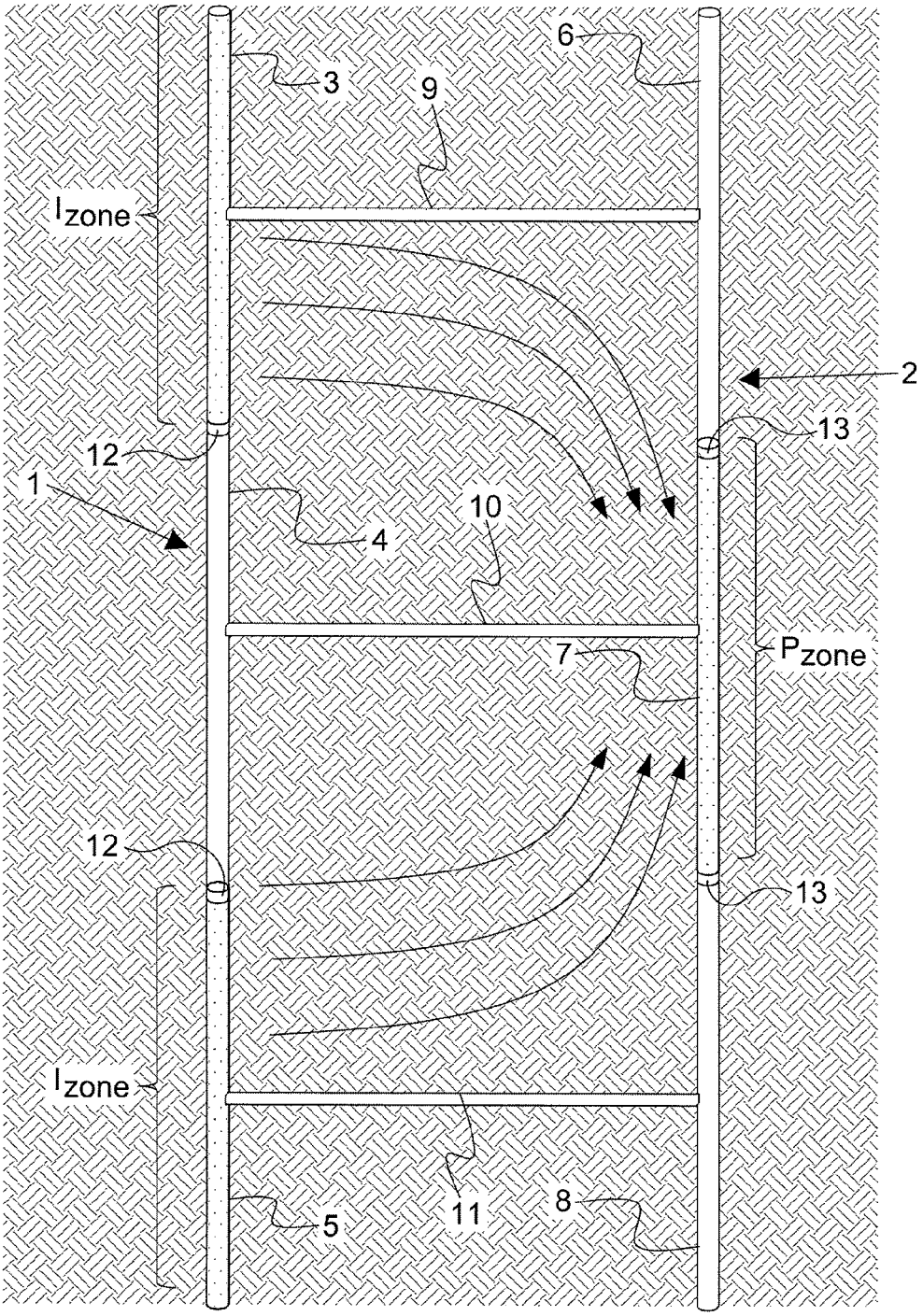
FIG. 1 illustrates schematically a cross section view of a formation having a first and a second well.

FIG. 1 shows schematically a first well 1 and a second well 2. In a typical tight formation, the wells are disposed substantially horizontally. It will be appreciated that the wells may be at any angle to best match the shape of the oil-bearing subterranean formation in which they are located. Furthermore, the first well 1 and the second well 2 are shown as being disposed parallel to one another. While this configuration may be optimum, it will be appreciated by the skilled person that the wells may deviate from being parallel to one another, again dependent on the formation in which they are located. The distance between the first well and the second well can be selected depending on many factors, such as the pressure in the reservoir, the permeability of the formation, the viscosity of the oil to be produced and so on. A typical distance may be around 400 m, but it will be appreciated that this can vary greatly.

The first well 1 is divided into zones; in the example of FIG. 1, a first zone 3, a second zone 4 and a third zone 5 are shown. It will be appreciated that many more zones may be provided along the length of the first well 1. The zones are substantially hydraulically isolated from one another by isolating material 12, meaning that fluids cannot pass from one zone to another (or at least, the flow of fluid is severely restricted between zones depending on the type of isolation used).

Similarly, the second well 2 is divided into zones; in the example of FIG. 1, a first zone 6, a second zone 7 and a third zone 8 are shown. It will be appreciated that many more zones may be provided along the length of the second well 2. Again, the zones are substantially hydraulically isolated from one another by isolating material 13, meaning that fluids cannot pass from one zone to another, or the flow of fluid is severely restricted between zones depending on the type of isolation used.

The zones in the first well 1 and the second well 2 may be any suitable length, depending on factors such as the pressure in the reservoir, the permeability of the formation, the viscosity of the oil to be produced and so on. A typical length is around 25 m to 100 m but can vary greatly.

There are various ways that zones can be hydraulically isolated from one another. For example, packers, swell packers, hydraulically set packers or cement may be used to ensure no or little fluid communication between zones.

Fractures are induced between the zones of the two wells 1, 2. In the example of FIG. 1, a first fracture 9 is induced between the first zones 3, 6 of the first well 1 and the second well 2 respectively, a second fracture 10 is induced between the second zones 4, 7 of the first well 1 and the second well 2 respectively, and a third fracture 11 is induced between the third zones 5, 8 of the first well 1 and the second well 2 respectively. Note that in FIG. 1, the fractures are shown as clean lines extending between the first well and the second well. This is for illustrative purposes only. In reality, each fracture comprises a series of fractures of different lengths and sizes, and each fracture may be thought of as a zone of fractures rather than a single fracture. For the sake of simplicity, the term "fracture" is used herein to refer to a fractured region.

The fracturing operation must be carefully controlled to ensure that each fracture extends substantially between corresponding zones of the first well 1 and the second well 2. The fractures in FIG. 1 are shown as being substantially perpendicular to the wells 1, 2. It will be appreciated that, again, factors such as the shape and permeability of regions of the formation between the wells 1, 2 may dictate that the fractures deviate from being perpendicular to the wells 1, 2.

The fractures are induced by any suitable means. Examples of techniques for inducing fractures between the wells include hydraulic fracturing, thermal fracturing, mechanical fracturing, and a combination of those methods. Where hydraulic fracturing is used, a fracturing may include proppants to ensure that a portion of the fractures remain open after the fracturing operation is complete.

In use, different zones are designated as injector zones or production zones. In the example of FIG. 1, the first and third zones 3, 5 of the first well 1 are designated as injector zones, and the second zone 7 of the second well 2 is designated as a production zone. The remaining zones are closed.

An injection fluid is injected through the first 3 and third zone of the first well 1. The main fluid path for the injection fluid is from the injector zones towards the production zone (the second zone 7 of the second well 2). This ensures that the injection fluid is forced through the formation between the wells 1, 2 and carries hydrocarbons with it. By forcing injection fluid through the formation in this way, a greater volume of the oil-bearing formation is available for production of oil, and oil production yields are increased. The arrows in FIG. 1 show the direction of flow of both injection fluid and produced oil towards the production zone 7. This type of flooding is termed cross-flooding.

Different zones can change their function. For example, once sufficient oil has been extracted using the first 3 and third 5 zones of the first well as injector zones, these zones can be closed off and the second zone 4 of the first well 1 can become an injector zone (along with, say, a fourth, sixth, eighth and so on zone). This allows more of the formation to be subjected to the injection fluid and increase yields. In this case, the second zone 7 of the second well 2 will be closed off, and the first 6 and third 8 zones of the second well 2 are opened for production.

One way to change the injector and production zones is to provide openable openings in each zone. The openings provide a communicating path between the wells and the formation. The openings can be selectively opened or closed depending on which zone will be an injector zone and which zone will be a production zone.

Similarly, different wells can change their function. In the example of FIG. 1, the first well 1 is used to inject fluid, and the second well 2 is used to produce hydrocarbons. This may be reversed so the second well becomes an injector well, and the first well becomes a production well.

Any suitable injection fluid may be used. Examples include carbon dioxide, hydrocarbons, methane, produced gas, nitrogen, hydrogen sulphide, water, surfactant, alkali, ketones, alcohols, aromatic hydrocarbons, hydrocarbons, solvents, and acid.

Injection fluids with different functions may also be used. For example, injection fluids may act as a diluent, a solvent, a reactant or a surfactant. Different combination of fluids can be used to optimize production. Furthermore, the type of injection fluid may be selected based on the type of hydrocarbon to be produced, the pressure and temperature in the formation, the viscosity of the hydrocarbon, the distance between wells and so on.

Figure 2:
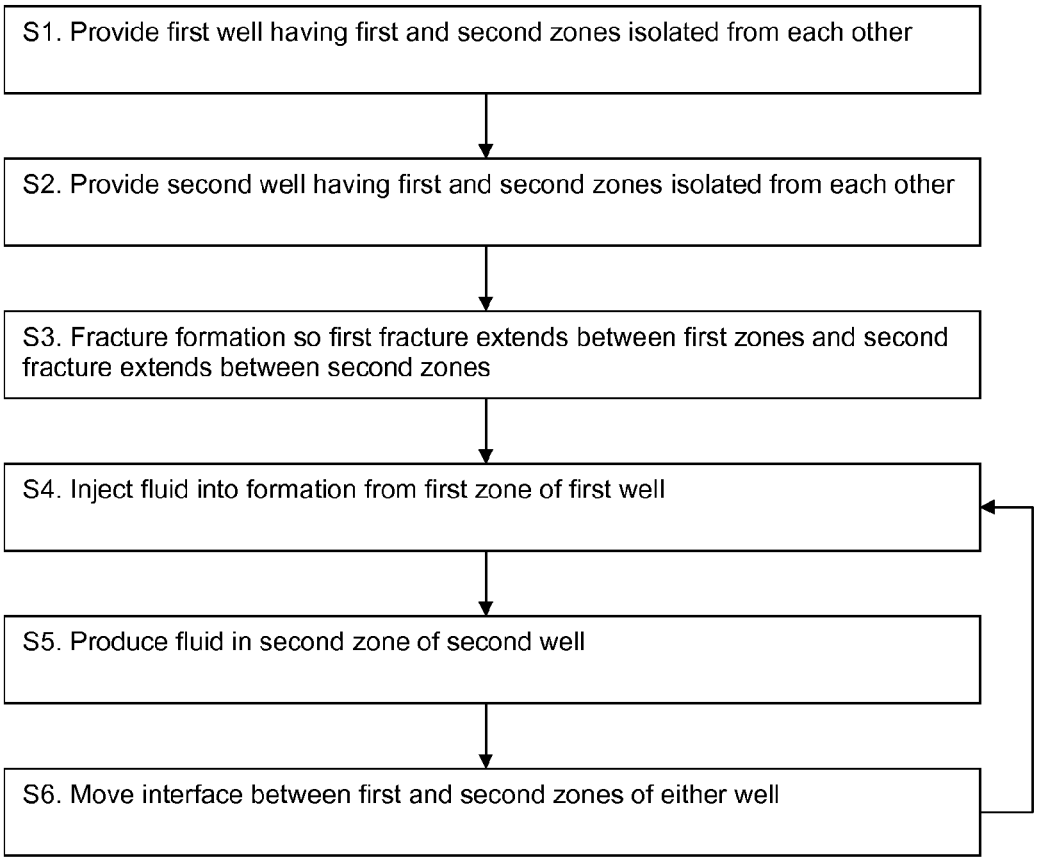
FIG. 2 is a flow diagram showing exemplary steps.

Turning now to FIG. 2, a flow diagram shows exemplary steps of the cross-flooding technique described herein. The following numbering corresponds to that of FIG. 2:

S1. A first well 1 is provided in the formation. The first well has at least a first 3 and a second 4 zone, the first and second zones being substantially hydraulically isolated from each other.

S2. A second well 2 is provided in the formation. The second well has at least a first 6 and a second 7 zone, the first and second zones being substantially hydraulically isolated from each other. The second well 2 is optimally substantially parallel to the first well 1.

S3. The formation is fractured so that a first fracture 9 extends substantially between the first zone 3 of the first well 1 and the first zone 6 of the second well 2. A second fracture 10 extends substantially between the second zone 4 of the first well 1 and the second zone 7 of the second well 2.

S4. In this example, the first zone 3 of the first well 1 is used as an injection zone, and the second zone 7 of the second well 2 is used as a production zone. Injection fluid is injected from the first zone 3 of the first well.

S5. The injected injection fluid is forced through the formation towards the second zone 7 of the second well 2, carrying hydrocarbons from the formation with it. Hydrocarbons are therefore produced at the second zone 7 of the second well 2.

S6. As mentioned above, the designations of injection zones, production zones, injection wells and production wells may be changed at any point, and the method reverts to step S4. Furthermore, interfaces may be moved between different zones and the method reverts to step S4. Interfaces may be moved by, for example, changing the location of packers.

The systems and methods described above allow the maximization of pressure gradients across the formation to provide improved oil recovery rates by reducing the distance that injected fluid must travel through the formation before production, while minimizing fluid channelling between connected fractures.

The isolated zones in each well 1, 2 allow for injection of injection fluids to occur offset to production as shown in FIG. 1, requiring injected fluid to traverse the formation in a direction substantially parallel to a main axis of the wells, allowing hydrocarbons to be produced where the induced fracturing may be less substantial and less connected than in the direction orthogonal to the wellbore. Furthermore, the distance that injection fluid (and produced hydrocarbons) must traverse in the direction parallel to the wellbore through the formation is relatively small compared to the distance typically traversed between wells in a conventional flood, allowing for larger pressure gradients and more economic production rates.

The completions configuration for these wells can be relatively simple. Several methods are available. One exemplary method consists of using several packers for zonal isolation in the wellbore along with a tubing string running a portion of the wellbore and penetrating at least one packer where the tubing string may have one or more sliding sleeves to control and or restrict the flow in each zone. This configuration requires much less complicated completions than in either the adjacent and proximal well configuration or the single well configurations discussed above, and is thus more reliable and less expensive.

The system may be provided with monitoring systems to determine the efficiency of production at each production zone. Production zones can be changed as a result of this monitoring.

Figure 3:
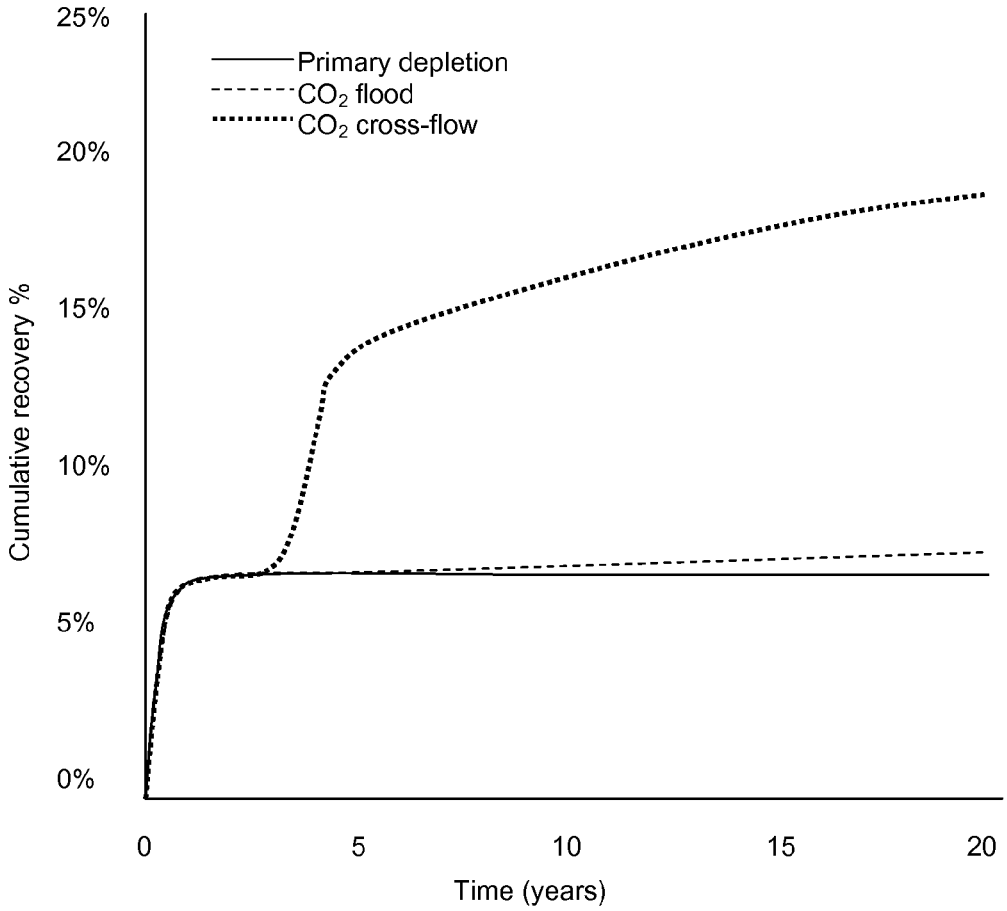
FIG. 3 is a graph comparing productivity of primary oil depletion compared with oil depletion using the techniques described herein.

FIG. 3 shows modelled recovery rates of oil from tight formations. The solid line represents primary depletion of oil without any injection fluid. The dashed line gives the example of a traditional $CO_2$ flood from well to well. It can be seen that over time, cumulate recovery improves marginally. Using the cross-flooding techniques described herein (dotted line), secondary depletion is expected to improve and recovery is significantly improved over the lifetime of the well.

The cross-flooding techniques described above can lead to cost-effectively allowing the production of significant oil reserves in formations that cannot be cost-effectively produced using existing techniques. The method maximizes pressure gradients and minimizes the distance that injection fluid and hydrocarbons must traverse through the formation while minimizing potential channelling effects and rapid breakthrough due to fracturing.

The skilled person will appreciate that various modifications may be made to the above described embodiments without departing from the scope of the present invention.

The invention claimed is:

1. A method of producing hydrocarbons from a subterranean formation, the method comprising:

providing a first well in the formation, the well separated by an isolating material into at least a first and a second zone, the first zone being substantially isolated from the second zone;

providing a second well in the formation, the second well separated by an isolating material into at least a first and a second zone, the first zone being substantially isolated from the second zone;

providing a first fracture in the formation, wherein the first fracture is a continuous, uninterrupted zone of fractures extending from the first zone of the first well to the first zone of the second well;

providing a second fracture in the formation, wherein the second fracture is a continuous, uninterrupted zone of fractures extending from the second zone of the first well to the second zone of the second well;

injecting a fluid into the formation from the first zone in the first well, to thereby put a portion of the formation between the first fracture and the second fracture under pressure; and producing hydrocarbons at the second zone of the second well.

2. The method according to claim 1, wherein each zone comprises openable openings providing a communicating path between the wells and the formation, the method comprising opening the openings in the first zone of the first well and the second zone of the second well, and closing the openings in the second zone of the first well and the first zone of the second well.

3. The method according to claim 2, the method further comprising closing the openings in the first zone of the first well and the second zone of the second well, and opening the openings in the second zone of the first well and the first zone of the second well, and injecting a fluid into the formation from the second zone of the first well.

4. The method according to claim 1, wherein the fluid is selected from any of carbon dioxide, hydrocarbons, methane, produced gas, nitrogen, hydrogen sulphide, water, surfactant, alkali, ketones, alcohols, aromatic hydrocarbons, hydrocarbons, solvents, and acid.

5. The method according to claim 1, wherein the fluid comprises any of a diluent, a solvent, a reactant and a surfactant.

6. The method according to claim 1, comprising providing the fractures by performing an operation selected from any of hydraulic fracturing, thermal fracturing, mechanical fracturing, and a combination thereof.

7. The method according to claim 1, wherein at least a portion of the first and second fractures are substantially perpendicular to a main axis of the first and second wells.

8. The method according to claim 1, wherein the first and second wells are disposed substantially horizontally in the subterranean formation.

9. The method according to claim 1, wherein the subterranean formation comprises a low permeability formation.

10. The method according to claim 1, wherein the first and second zone of each wellbore are hydraulically isolated from each other using any of a packer, a swell packer, a hydraulically set packer, and cement.

11. The method according to claim 1, further comprising subsequently changing the location of an interface between the first and second zones of either of the first and second wells.

12. A system for producing hydrocarbons from a subterranean formation, the system comprising:

a first well in the formation, the well separated by an isolating material into at least a first and a second zone, the first zone being substantially isolated from the second zone;

a second well in the formation, the second well separated by an isolating material into at least a first and a second zone, the first zone being substantially isolated from the second zone;

a first fracture in the formation, wherein the first fracture is a continuous, uninterrupted zone of fractures extending from the first zone of the first well to the first zone of the second well;

a second fracture in the formation, the second fracture is a continuous, uninterrupted zone of fractures extending from the second zone of the first well to the second zone of the second well;

an injector for injecting a fluid into the formation from the first zone in the first well to thereby put a portion of the formation between the first fracture and the second fracture under pressure, wherein the injection of the fluid leads to production of the hydrocarbons at the second, zone of the second well.

13. The system according to claim 12, further comprising openable openings in each zone, the openings providing a communicating path between each well and the formation.

14. The system according to claim 13, wherein the openable openings are configured to be selectively opened or closed, to respectively determine that either the zone will be an injector zone or a production zone, or the zone will not be an injector zone or a production zone.

15. The system according to claim 12, wherein the injected fluid is selected from any of carbon dioxide, hydrocarbons, methane, produced gas, nitrogen, hydrogen sulphide, water, surfactant, alkali, ketones, alcohols, aromatic hydrocarbons, hydrocarbons, solvents, and acid.

16. The system according to claim 12, wherein the injected fluid comprises any of a diluent, a solvent, a reactant and a surfactant.

17. The system according to claim 12, wherein the first and second fractures are substantially perpendicular to a main axis of the first and second wells.

18. The system according to claim 12, wherein the first and second wells are disposed substantially horizontally in the subterranean formation.

19. The system according to claim 12, wherein the subterranean formation comprises a low permeability formation.

20. The system according to claim 12, wherein the first and second zone of the each wellbore are hydraulically isolated from each other using any of a packer, a swell packer, a hydraulically set packer and cement.

* * * * *